US012305963B1

(12) United States Patent
Schmutter

(10) Patent No.: US 12,305,963 B1
(45) Date of Patent: May 20, 2025

(54) MOBILE AND STATIONARY PROTECTIVE ATTENDANT STATIONS

(71) Applicant: Bruce Schmutter, Long Island City, NY (US)

(72) Inventor: Bruce Schmutter, Long Island City, NY (US)

( * ) Notice: Subject to any disclaimer, the term of this patent is extended or adjusted under 35 U.S.C. 154(b) by 131 days.

(21) Appl. No.: 18/216,120

(22) Filed: Jun. 29, 2023

Related U.S. Application Data

(60) Provisional application No. 63/388,679, filed on Jul. 13, 2022.

(51) Int. Cl.
*F41H 5/24* (2006.01)
*F41H 5/04* (2006.01)
*F41H 5/08* (2006.01)

(52) U.S. Cl.
CPC ..... *F41H 5/24* (2013.01); *F41H 5/0407* (2013.01); *F41H 5/08* (2013.01)

(58) Field of Classification Search
CPC ..... F41H 5/24; F41H 5/0407; F41H 5/08
USPC ..... 89/36.01
See application file for complete search history.

(56) References Cited

U.S. PATENT DOCUMENTS 1,253,964 A * 1/1918 Hack ..... F41H 5/14 109/9
1,735,966 A * 11/1929 Garver ..... E05G 1/024 109/9
4,245,546 A * 1/1981 Chaires ..... F41H 5/08 109/49.5
4,781,101 A * 11/1988 Zevuluni ..... F41H 5/14 280/755
6,711,980 B2 * 3/2004 Kropf ..... F41H 7/02 89/36.15
6,845,701 B2 * 1/2005 Drackett ..... F41H 5/14 89/36.09
8,006,986 B1 * 8/2011 Pazhoor ..... E04H 1/1255 312/294
8,701,544 B2 4/2014 Peters et al.
8,850,949 B1 10/2014 Lopez
9,528,797 B2 12/2016 Hardwood et al.
9,638,496 B2 5/2017 Peters et al.
D790,243 S 6/2017 Georgiadis et al.
9,835,429 B2 12/2017 Kerns et al.
(Continued)

*Primary Examiner* — Samir Abdosh
(74) *Attorney, Agent, or Firm* — Caesar Rivise, PC

(57) ABSTRACT

An apparatus and method for a protective attendant station (PAS) that may be either mobile or stationary. The PAS has an upper protective portion having a front and two side bullet-resistant transparent/translucent panels and a lower protective portion that uses bullet-resistant material (e.g., stainless steel) and wherein, in the mobile PAS version, the lower protective portion rests upon and is secured to wheel/castor assemblies. The front panel comprises one of several protective window configurations (PWCs) that facilitate speaking between the attendant and another person, while protecting the attendant from the COVID transfer or other potentially infectious diseases, from reach-through or from firearm discharge. The mobile PAS includes a brake mechanism that permits the attendant to move the PAS defensively to a more secure location, or to be used offensively against a perpetrator by moving the PAS against the perpetrator and pinning him/her to a wall or other structure until authorities arrive.

16 Claims, 16 Drawing Sheets

(56) References Cited

U.S. PATENT DOCUMENTS

| | | | | |
|---|---|---|---|---|
| 10,172,448 | B2 | 1/2019 | White et al. | |
| 10,206,499 | B2 | 2/2019 | Purifoy | |
| 10,295,311 | B1 | 5/2019 | Trubacek et al. | |
| 10,330,443 | B2 | 6/2019 | Wemhoener et al. | |
| 10,401,126 | B1 | 9/2019 | Kolomijez et al. | |
| D865,065 | S | 10/2019 | Georgiadis et al. | |
| 10,591,258 | B1 | 3/2020 | Drummond et al. | |
| 2003/0213359 | A1* | 11/2003 | Kropf | F41H 5/14 89/36.09 |

* cited by examiner

Side View

Front View

Top View

MOBILE AND STATIONARY PROTECTIVE ATTENDANT STATIONS

CROSS-REFERENCE TO RELATED APPLICATIONS

This non-provisional application claims the benefit under 35 U.S.C. § 119(e) of Application Ser. No. 63/388,679 filed on Jul. 13, 2022 entitled MOBILE AND STATIONARY PROTECTIVE ATTENDANT STATIONS and whose entire disclosure is incorporated by reference herein.

BACKGROUND OF THE INVENTION

This present invention relates to barriers, and more particularly, to a bullet-resistant protective attendant station that can be either mobile or stationary while also protecting the attendant from Covid or other airborne bacteria as well as from reach-through by a visitor.

In today's environment both in-terms of airborne disease mitigation and active shooter response, facilities have new/additional responsibilities in managing the daily interactions between staff and building occupants. Threats incurred include ongoing airborne transfer of potentially infectious material as well as a variety of violent/active shooter scenarios. Security personnel need the ability to interact with the public on a daily basis without the concern of putting themselves at unnecessary risk. The public must feel welcome however be intuitively guided to the designated speaking/transaction area.

Moreover, security personnel must be able to quickly respond to situations ranging from isolating themselves from harm; to rescuing a building occupant; to detaining a potential perpetrator. Overall, the solution, or solutions, to the above concerns must accommodate usage by a wide range of height/weight individuals. Drawers, braking system, rollers, handles and response tool deployments must all be user-friendly and intuitive. These solutions must allow for individual preference of sitting or standing and provide the same level of ease for public interactions and staff safety. These solutions must be designed to withstand extended high cycle usage with long-term reliability, providing consistent operation and level of protection.

Current work locations are interspersed leaving adjacent areas vulnerable as surrounding structures offer no ballistic protection. Air circulation and other factors do not allow the barrier walls to connect or seal to the slab or soffit creating structural complexities. Height constraints allow the potential for an intruder to climb over the structure regardless of the ballistic level used. The material weight per square foot: Current unbreakable thermoplastic Lexan®-2.0, Level I Ballistic-5.0 and Level III Ballistic-7.5 pounds and there is only minimal advantage of increased ballistic characteristics beyond Level I.

FIGS. 1A-1C are three examples of currently available attendant stations. However, each pictured option has a manufacturer's rating of Level III ballistic protection. The actual realized benefit is only during the scenario of a sitting staff member and a perpetrator discharging his weapon at a maximum height of 48". Moreover, the designs offer no Covid isolation characteristics.

FIG. 1D is another example of a currently available attendant station, of a larger configuration. It comprises a unitized construction formed at an off-site fabrication center. It maintains staff protection for the full height up 8 feet. The glazing requires four-sided framing, 20+ week lead-time and requires substantial rework to make it aesthetic.

In response to ongoing concerns regarding staff safety discussed above, there is a need for established perimeters and/or boundaries between staff and patients, visitors or others. Clinical needs and intruder management requirements add additional factors to overcome.

The present invention solves these problems.

All references cited herein are incorporated herein by reference in their entireties.

BRIEF SUMMARY OF THE INVENTION

A protective attendant station (PAS) is disclosed. The station comprises: an upper portion comprising a protective window configuration that is bullet-resistant and transparent (e.g., bullet-resistant UL752 glazing and hardened materials); a lower portion that is also bullet-resistant; and wherein the upper portion and the lower portion are secured together to form a station having an interior configured for the presence of an attendant therein and wherein the bullet-resistant and transparent upper portion provide unobstructed communication between the attendant and another person on an outside location of the protective attendant station while also preventing transfer of moisture droplets while minimizing transfer of Covid and other potentially infectious diseases between the another person and the attendant.

A protective attendant station that utilizes one of four different protective window configurations (PWCs):

- wherein the PWC comprises a pair of bullet-resistant and transparent panes which are vertically-oriented such that one pane forms an upper pane and the other pane forms a lower pane and wherein a lower edge of the upper pane overlaps an upper edge of the upper pane, and wherein the lower pane has a lower edge that is in contact with a countertop in the upper portion;
- wherein a lower edge of the upper pane overlaps an upper edge of the lower pane but the upper and lower panes are displaced horizontally to form a gap to facilitate speaking and protecting against airborne bacteria, and wherein the lower pane has a lower edge that is in contact with a countertop in the upper portion;
- wherein said lower pane has a lower edge that is positioned above a countertop in said upper portion to allow for pass-through of materials; and
- wherein, in addition to the panes mentioned above, an angled bullet-resistant and transparent pane is positioned on the countertop, inward of the station, to permit limited pass-through of materials, while protecting the attendant from any reach-through or any airborne bacteria.

Another aspect of the present invention is a mobile protective attendant station that permits the attendant to move the protective attendant station and then temporarily fix it in place using a braking mechanism for either defensive purposes or offensive purposes when confronted by an armed perpetrator or an out-of-control person.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1A:
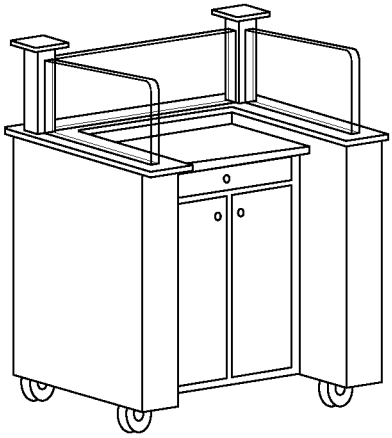
FIG. 1A (PRIOR ART)
FIGS. 1A-1D provide examples of currently available attendant stations, stationary and mobile.
Figure 1B:
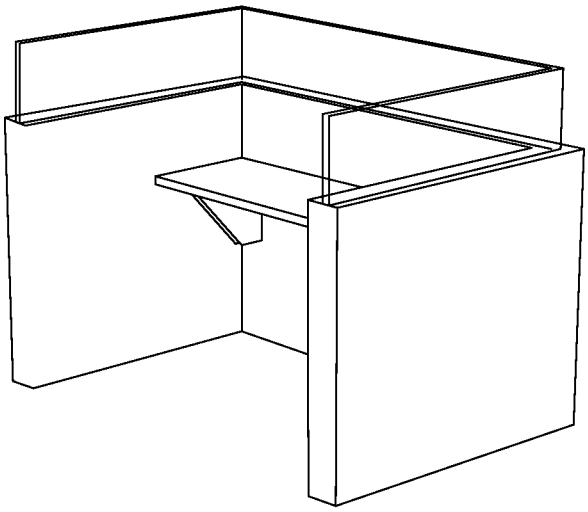
FIG. 1B (PRIOR ART)
Figure 1C:
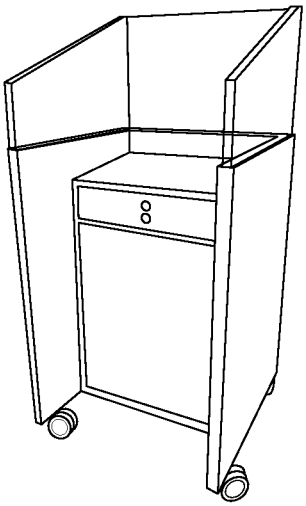
FIG. 1C (PRIOR ART)
Figure 1D:
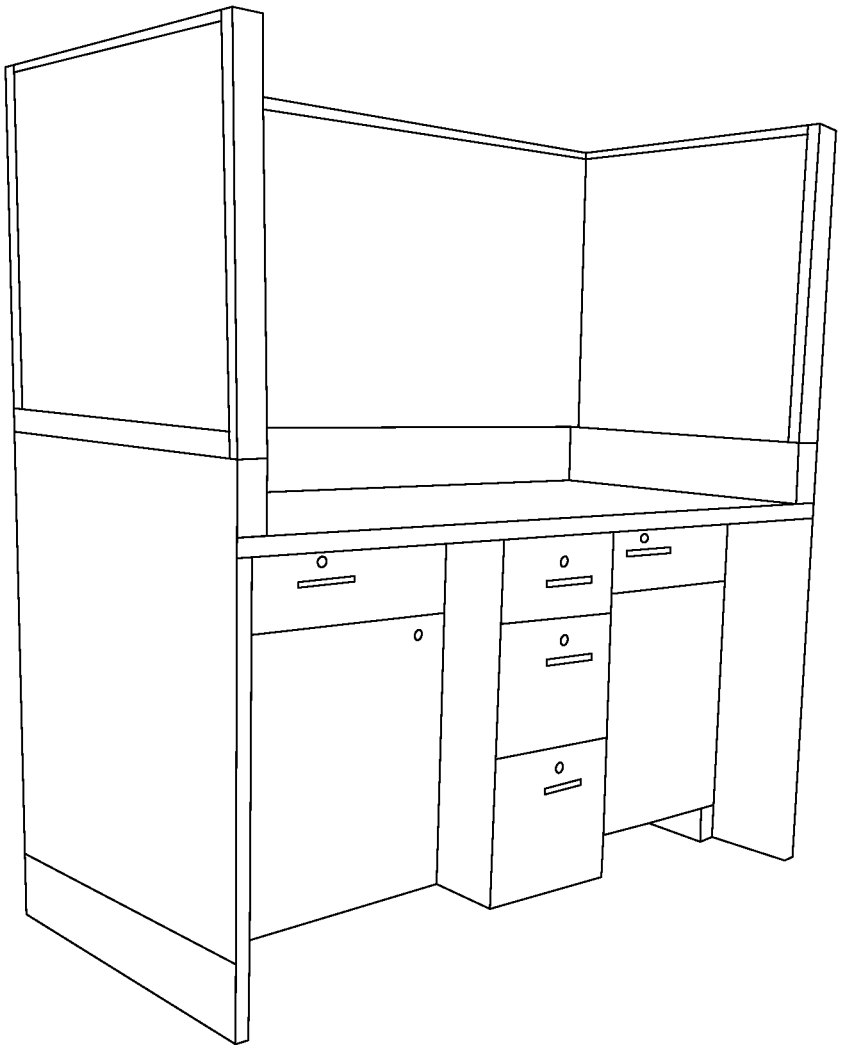
FIG. 1D (PRIOR ART)

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

The present invention addresses all of the concerns of the current state of the art by including the following features:

- A podium that allows for daily unobstructed communication with the public and capable of withstanding the daily environment;
- An enclosure that prevents the transfer of moisture droplets and minimizes transfer of COVID and other potentially infectious diseases, which includes isolating staff from patients and general public without inhibiting daily job function;
- An ergonomically correct design, including ergonomic for ADA patients, to allow for security personnel to either sit or stand and be protected on 3 sides;
- A braking system that ensures the podium is stabilized even on non-level floor surfaces;
- A cabinet designed for concealed storage and rapid deployment of a ballistic-resistant shield;
- A front overlapping ballistic rated clear material to allow for clear communication without concern of lethal weapon of droplet transfer;
- The ability to utilize as a "safety pod" to rescue a building occupant and safely relocate podium against the wall for 360° protection;
- The ability to utilize for containment, trapping the potential perpetrator between the pod and another structure (e.g., a wall) and retaining them until law enforcement arrival;
- A braking system designed to prevent accidental locking/unlocking of the podium; and
- Nonporous, easily maintained surfaces to sanitize on a regular basis reducing the spread of infection and viruses.
- Increased staff safety by the utilization of bullet-resistant UL752 glazing & hardened materials (including NIJ Level I guidelines) for an extended height Covid & violence barrier (including extended height barrier), which includes consistent ballistic protection above and below the countertop; The UL752 Standard sets forth the bullet resistance of building components, including windows, walls, or barriers manufactured using bullet-resistant materials.

Interface with the general public in an inviting fashion that embraces daily functions of communication, document and package transfer, including required secure document;

the structure can be imposing but without being obtrusive, thereby providing an aesthetic general appearance;

Cleanable by approved IC (viz., Infection Control) methods, including ICRA (Inspection, Cleaning and Restoration Association) standards, satin finish stainless steel to minimize fingerprints and maintainable with provision for future signage or decoration;

Provides appropriate sound transfer without compromising barrier characteristics;

Maintainable: individual sections can be replaced if scratched or damaged.

Figure 2A:
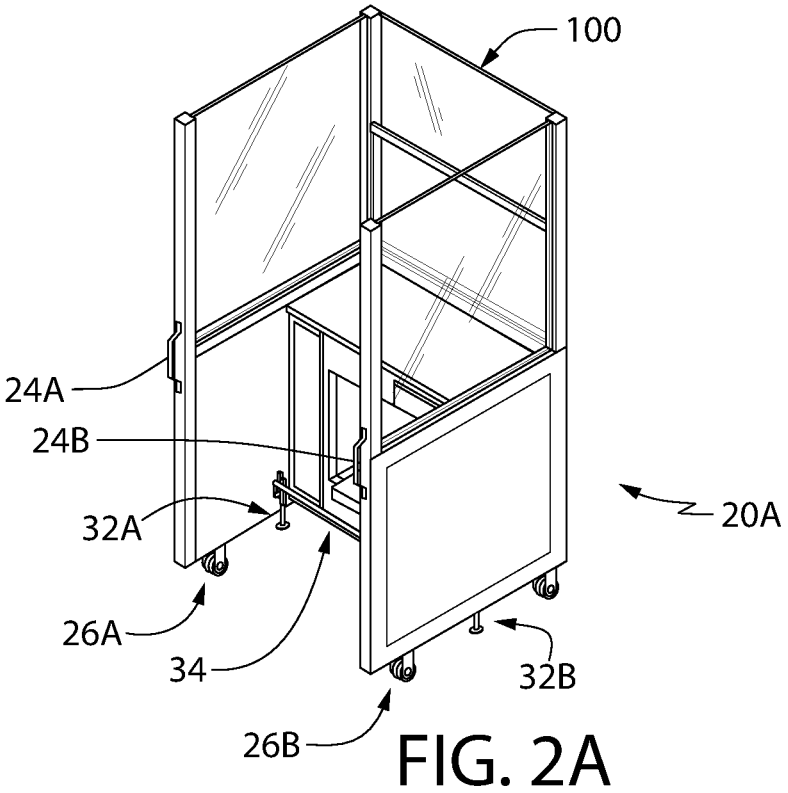
FIG. 2A depicts a mobile protective attendant station (PAS) of the present invention using a first protective window configuration with no holes or gaps.
Figure 2B:
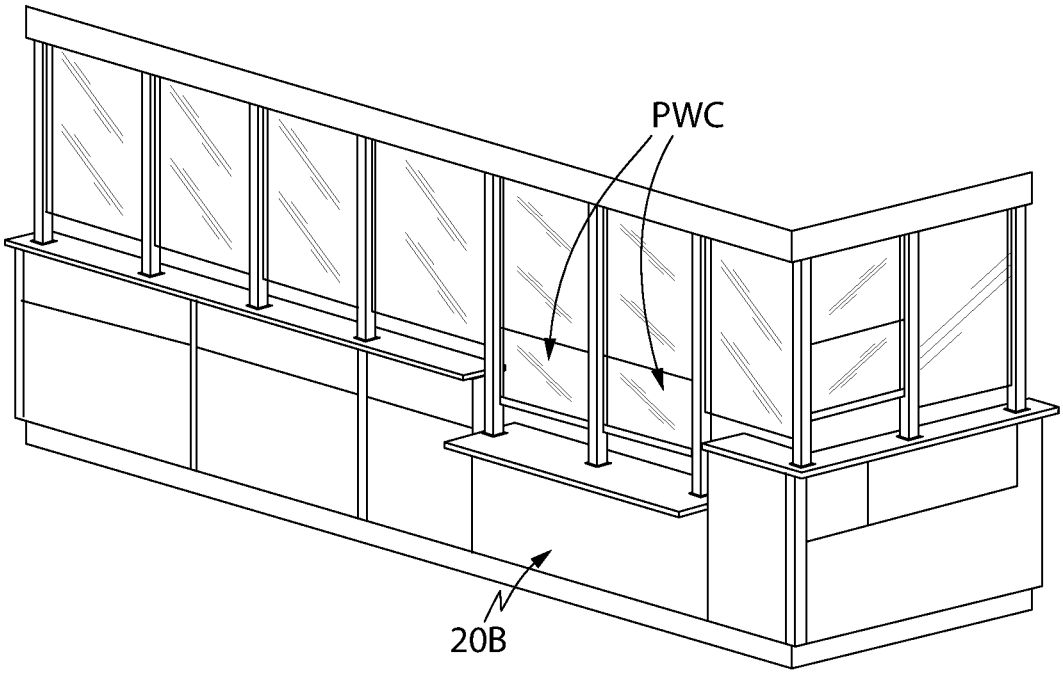
FIG. 2B depicts a stationary PAS of the present invention.

All of the above factors are incorporated into the invention of the present application which comprises a protective attendant station (PAS) that may either be a mobile PAS 20A (FIG. 2A) or a stationary PAS 20B (FIG. 2B). The mobile PAS 20A is also sometimes referred to as a "podium".

Figure 2C:
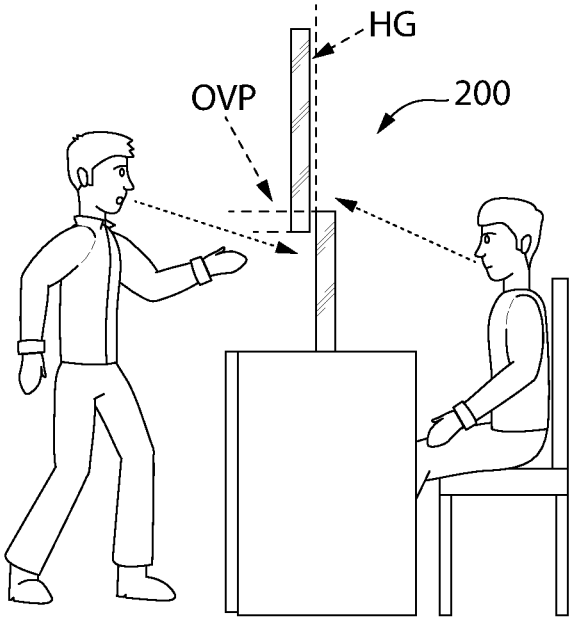
FIG. 2C is a functional diagram depicting a second protective window configuration of the present invention that supports safe speaking but no passage of materials.
Figure 2D:
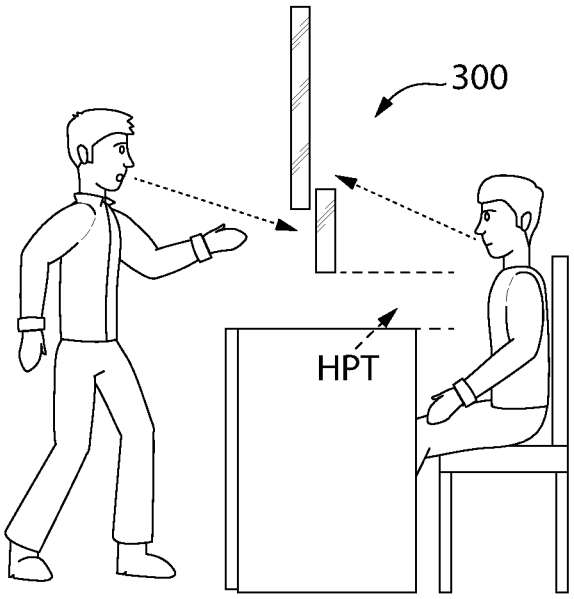
FIG. 2D is a functional diagram depicting a third protective window configuration of the present invention that supports safe speaking as well as the passage of materials.
Figure 2E:
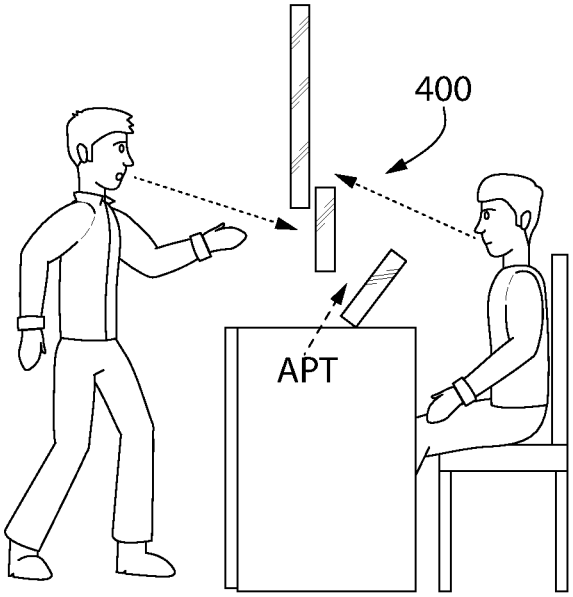
FIG. 2E is a functional diagram depicting a fourth protective window configuration of the present invention that supports the safety of the attendant as well as the passage of materials.
Figure 2F:
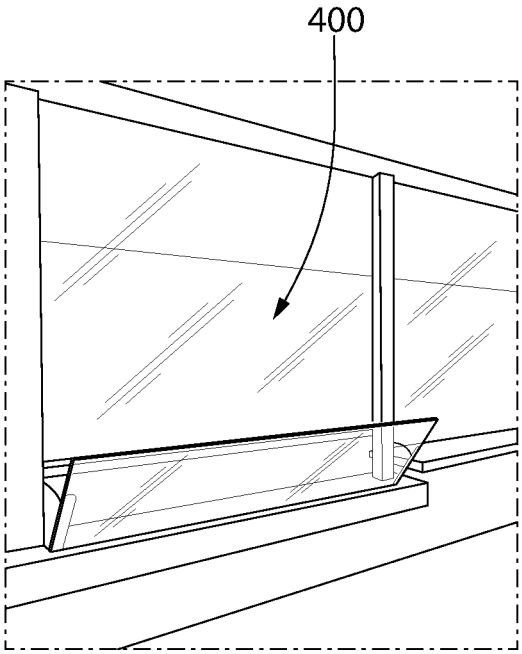
FIG. 2F shows the inside of the fourth protective window configuration of the present invention.
Figure 2G:
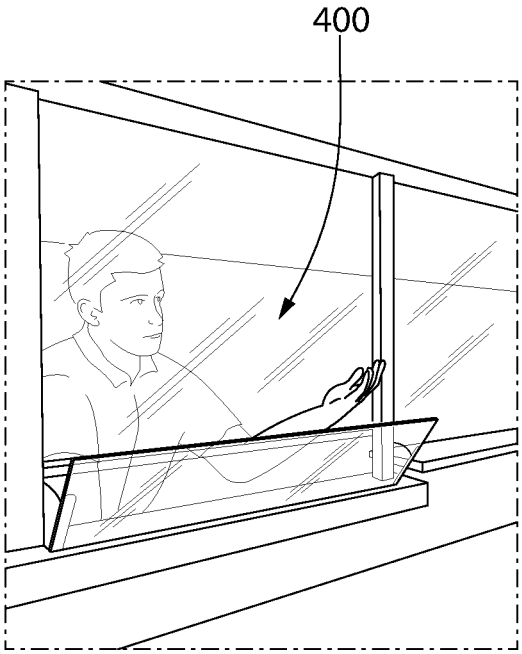
FIG. 2G also shows the inside of the fourth protective window configuration, as in FIG. 2F, of the present invention but with a person demonstrating the difficulty of trying to reach in and harm the attendant while being able to pass materials therethrough.

Both the mobile PAS 20A and the stationary PAS 20B, may comprise one of four different protective window configurations (PWC):

(1) PWC 100 (FIG. 2A) comprises vertical bullet-resistant panes with no holes or spacing, referred to as "stationary PWC" that also protects the attendant from Covid and other airborne diseases;

(2) PWC 200 (FIG. 2C) comprises a pair of vertical bullet-resistant panes but where an upper pane is both displaced horizontally away (horizontal gap "HG") from a lower pane and the upper pane's lower edge is positioned above the countertop and the lower edge of the lower pane is on the countertop. The upper pane and lower pane have overlapping portions OVP (e.g., 2 inches). This PWC is referred to as "speak only PWC"; this configuration also protects the attendant form Covid and other airborne diseases;

(3) PWC 300 (FIG. 2D) comprises a similar configuration to PWC 200 but where the lower edge of the lower pane is raised above the countertop (e.g., a 3 inch gap) to form a "horizontal pass through (HPT)". This is referred to as "transactional PWC" as content can be passed under the lower edge of the lower pane; this configuration also protects the attendant form Covid and other airborne diseases; and (4) PWC 400 (FIGS. 2E-2G) comprises and protective pass-through (also referred to as "angled pass-through APT") configuration that protects the attendant from Covid and other airborne diseases, and also protects the attendant from an assailant trying to reach through the opening, while allowing for the passage of materials therethrough.

All of these PWCs protect the attendant from a perpetrator from reaching through the window (e.g., to hit the attendant or seize items, etc.), or spitting or even coughing at the attendant through the window, in addition to the window elements being bullet-resistant. PWCs 200-400 support verbal/visual communication between the patron and the attendant due to the gap between the upper and lower window panes. PWCs 300-400 allow for pass-through of materials; PWC 400 allows for maximum acoustics while maintaining secure perimeter. It allows for document transfer while inhibiting patient access/violence. The PWC 400 involves minimal visual impact. The PWC 400 comprises dual upper and lower mountings for extreme impact protection. Another important feature of PWC 400 is that based on the angle of the tilted lower pane (e.g., 45°, but other angles may be used) and the gap between it and the lower vertical pane allows healthcare facilities to limit the size of medications being passed from attendant to patient. For example, where the patient may be unwilling to drink an 8 ounce cup of medication, or may even try to throw it against the PWC 400, the angle/gap may be designed to limit the size of the liquid container to, for example, 2 ounces, thereby providing the patient with a smaller amount of liquid to drink at any time and wherein a plurality of cups can then be passed to the patient, one at a time, to achieve the total dosage. The attendant can verify that the patient is drinking each passed cup therethrough, without risking the patient just discarding the entire (e.g., 8 ounces) of medication, should he or she become belligerent or disruptive.

Figure 2H:
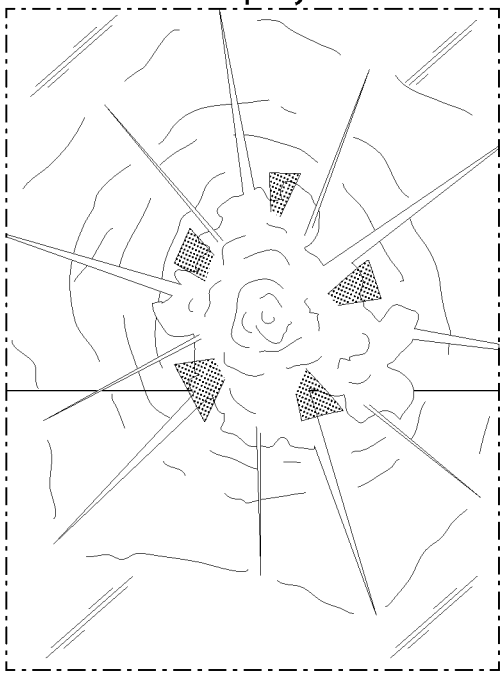
FIG. 2H depicts a bullet resistant barrier testing result of the protective window configurations of the present invention when a 9 mm bullet was fired thereat.
Figure 2I:
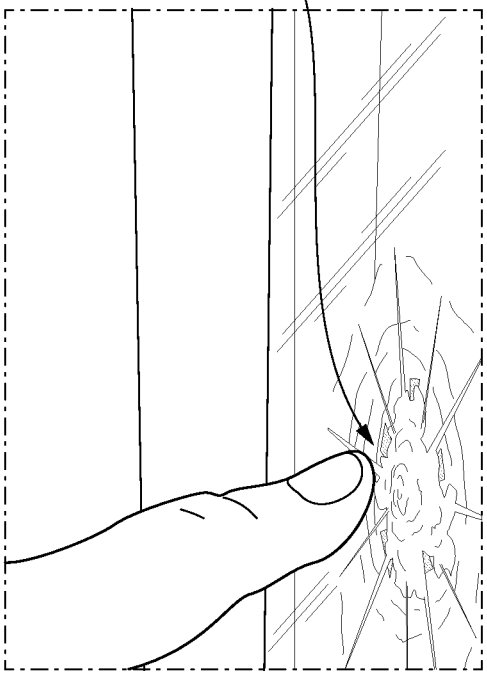
FIG. 2I illustrates an inner layer of the protective window configuration of the present invention with no penetration following the bullet resistant barrier test.

All of the PWCs incorporate bullet and forced-entry resistance similar to UL752 with a consistent level of protection above and below a counter portion. This allows staff to safely dispense medication and exchange documents while allowing multi-directional speaking across the entire 32 inch panel width. It also permits for the application of decorative & signage capabilities. FIG. 2H depicts a bullet resistant barrier testing result of the protective window configurations when a 9 mm bullet was fired thereat. FIG. 2I illustrates an inner layer of the protective window configuration with no penetration following the bullet resistant barrier test;

In view of the foregoing PWCs, the following discussion is directed to the two embodiments of PASs mentioned above, with the understanding that either of these embodiments may use any of the four PWCs.

Mobile Protective Attendant Station (PAS) 20A

Applicant has invented portable podium enclosures 20A primarily as a means for safe daily interaction between building security personnel and building occupants. The design criteria provide an extremely durable structure that provides intuitive operation with an aesthetic appearance. Overall design provides daily Covid isolation, the ability for effective communication and is quickly convertible for rapid response to a variety of situations including an active shooter.

Figure 3A:
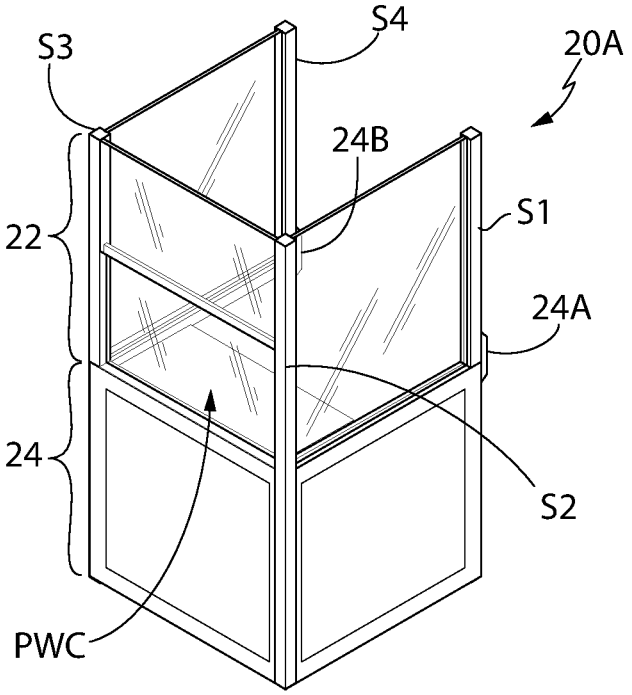
FIG. 3A is an isometric front view of a mobile PAS.
Figure 3B:
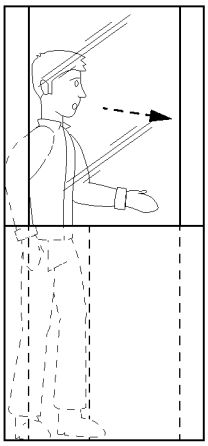
FIGS. 3B-3D provide functional diagrams of the mobile PAS.
Figure 3C:
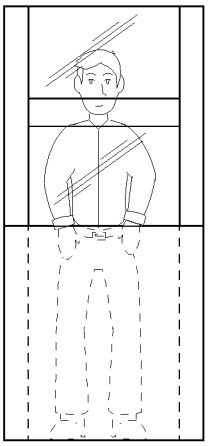
Figure 3D:
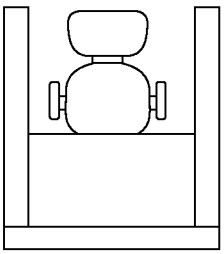
Figure 3E:
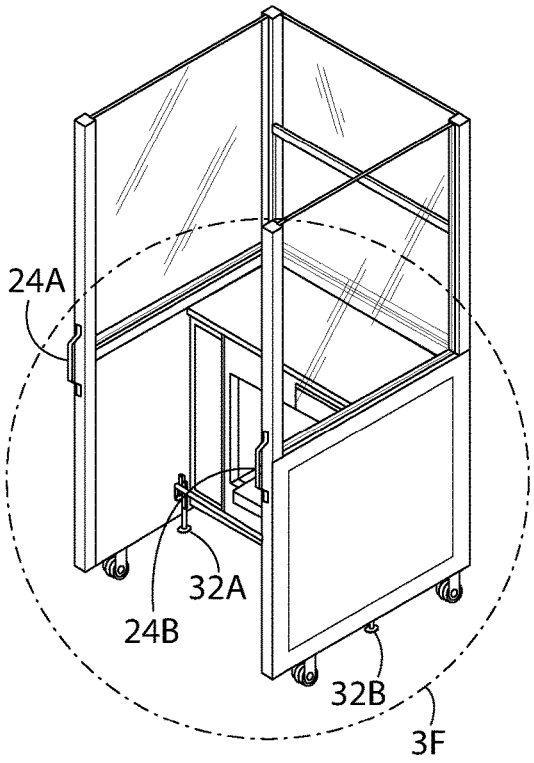
FIG. 3E is an isometric back view of a mobile PAS showing the internal side.

FIG. 3A is an isometric front view of a mobile PAS 20A and FIGS. 3B-3D provide functional diagrams of the mobile PAS 20A. Basically, as shown most clearly in FIG. 3A, the PAS 20A comprises an upper protective portion 22 using bullet-resistant transparent/translucent panels and a lower protective portion 24 that also comprises a bullet-resistant composition (e.g., a combination of 14-gauge stainless steel, ¾" plywood, 16-gauge stainless steel) and both portions of which are secured to four vertical struts S1-S4. The bottom of the lower protective portion 24 rests upon and is secured to wheel/castor assemblies 26A and 26B (FIGS. 3E-3F) that provide the mobility of the PAS 20A. The upper portion 22 comprises the three-sided bullet-resistant window panels, the front one of which forms the PWC discussed previously. Inside the lower portion 24 is a countertop CT underneath which is a storage assembly 28 (See FIG. 3F). Furthermore, a braking mechanism can be directly integrated with the wheel/castor assemblies 26A/26B to permit the PAS 20A to be fixed in a location and whereby the braking mechanism also can be released quickly by the attendant to make the PSA 20A mobile again using an attendant-controlled foot-activated brake bar 34.

The foot-activated brake bar 34 provides the attendant with a quick-action control to lock the PAS 20A in place quickly or to unlock the PAS 20A to quickly maneuver the PAS 20A, if necessary, in an emergency, or to relocate the PAS 20A in a non-emergency situation. FIG. 3G shows the brake bar 34 in the upward "unlocked" condition. When the brake bar 34 is in the unlocked condition, foot pads 32A and 32B are "elevated", out-of-contact with the floor (see reference character "x" in FIG. 3G showing the foot pads 32A/32B out-of-contact with the floor F while the wheel/castor assemblies 26A/26B are in-contact with the floor F), thereby allowing the PAS 20A to rest on the castors 26A and 26B, thus making the PAS 20A mobile (see also FIG. 3E where the foot pads 32A/32B are "elevated," out of contact with the floor F). Conversely, when the brake bar 34 is in the locked condition (FIG. 3H), the foot pads 32A and 32B have been extended "downward" to be in contact with the floor F (see reference character "y" in FIG. 3H indicating the wheel/castor assemblies 26A/26B are out-of-contact with the floor F while the foot pads 32A and 32B are in-contact with the floor F), thereby lifting the wheel/castor assemblies 26A and 26B off of the floor F, immobilizing the PAS 20 so that it can no longer move. As a result, the attendant can maintain his/her awareness of the environment without having to look down to either lock the PAS 20A in place or reconfigure the PAS 20A to become mobile; all of this is done with his/her foot.

Figure 3F:
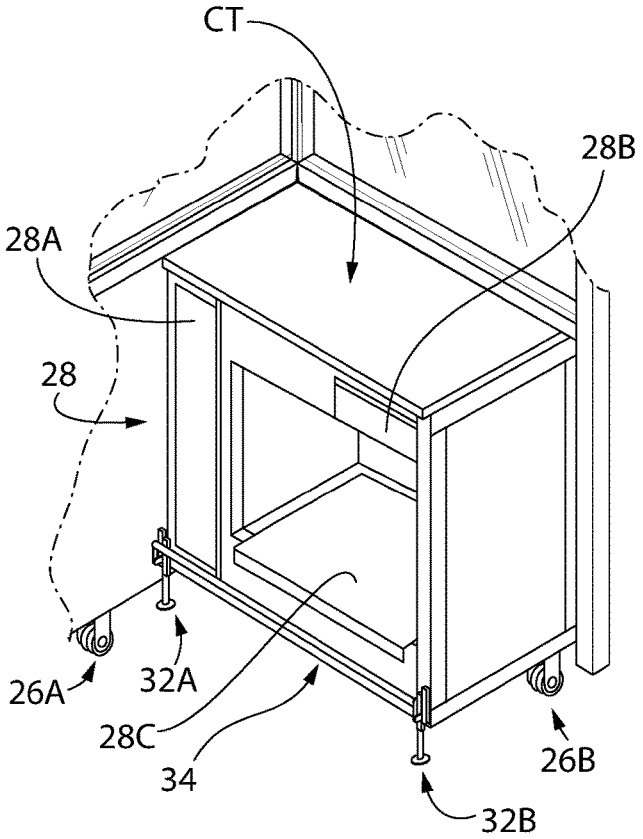
FIG. 3F is a partial isometric back view of the mobile PAS of FIG. 3E depicting the internal countertop with underneath storage units, wheel/castor assemblies with a brake bar and brake control.
Figure 3G:
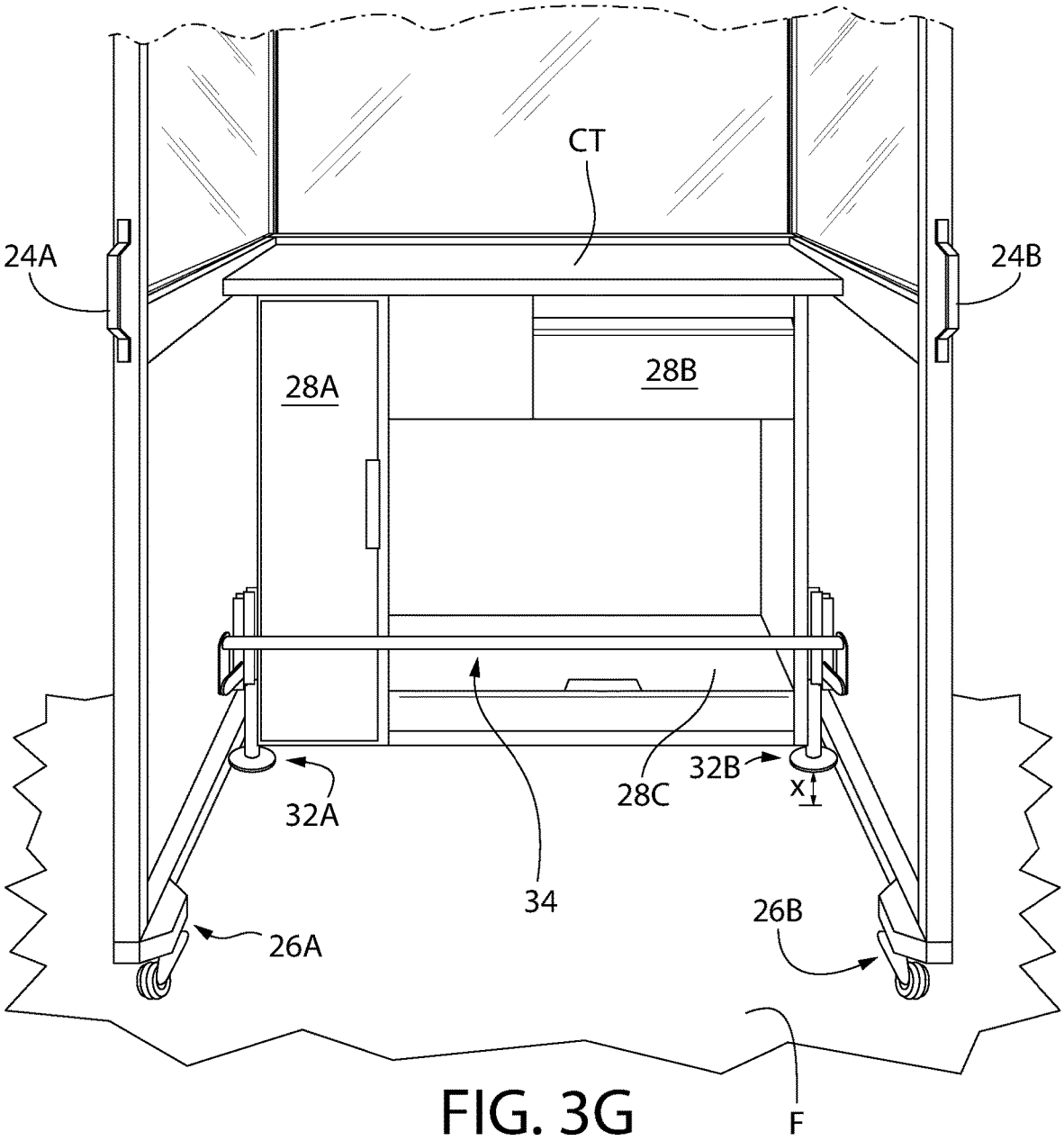
FIG. 3G depicts the lower portion of the interior of a mobile PAS showing the storage compartments and whereby the attendant-controlled braking mechanism is a foot-activated brake bar using vertically displaceable foot pads and is shown in the "unlocked" condition.
Figure 3H:
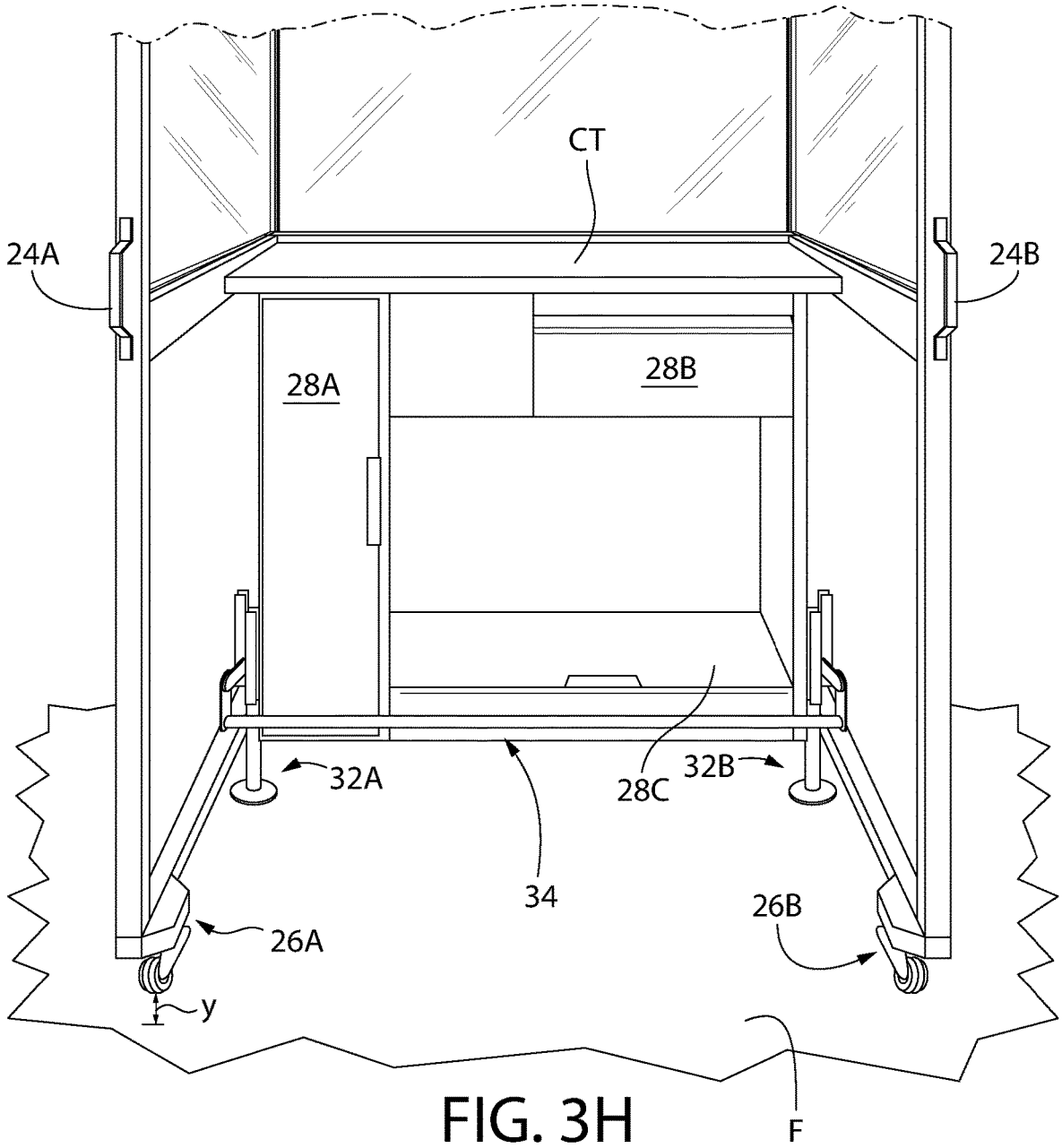
FIG. 3H depicts the lower portion of the interior of the mobile PAS of FIG. 3G but showing the attendant-controlled braking mechanism in the "locked" condition.
Figure 3J:
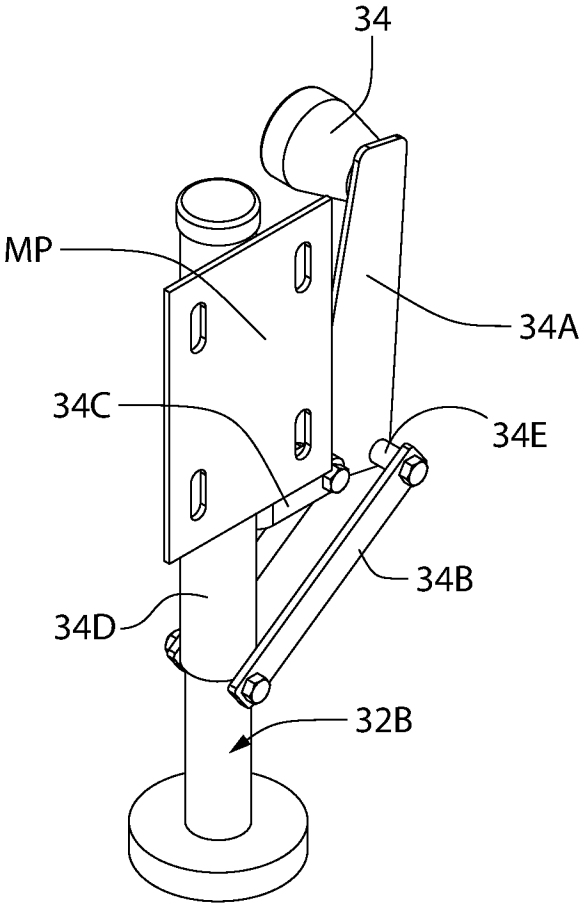
FIG. 3J is an isometric view of the control mechanism of FIG. 3I but shown in the "unlocked" condition.
Figure 3I:
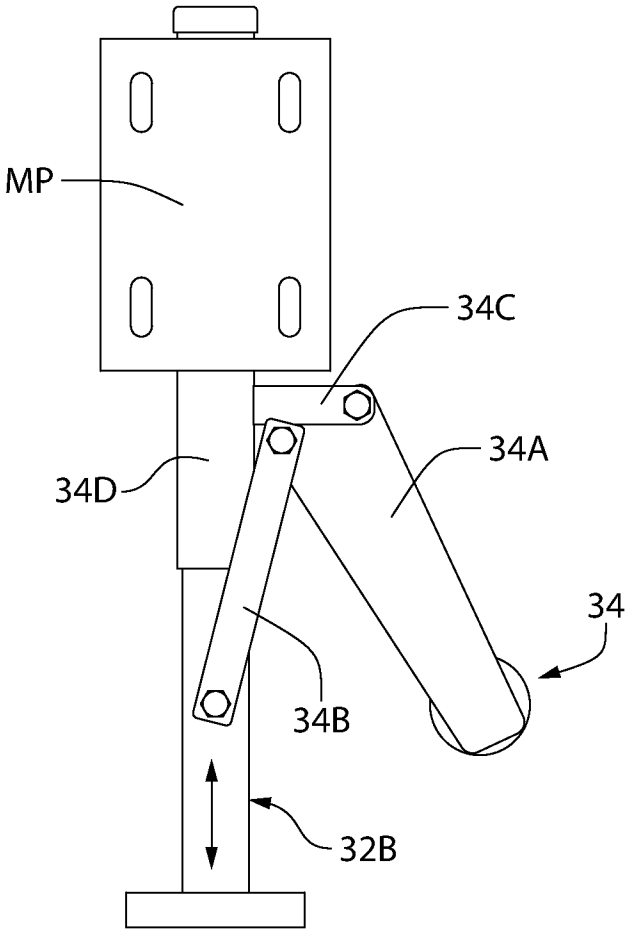
FIG. 3I is a side view of the control mechanism for the attendant-controlled foot-activated brake bar shown in the "locked" condition.

FIGS. 3I-3J depict one of the foot pads, namely, 32B and its releasable locking mechanism, it being understood that foot pad 32A has a similar releasable locking mechanism at the other end of the brake bar 34. Thus, together the brake bar 34 comprises a "dual point" releasable locking mechanism, whereby each end of the brake bar 34 comprises the respective foot pad 32A and 32B and their respective releasable locking mechanism.

In particular, the foot pad 32B can retract upward into a sleeve 34D to be "out-of-contact" with the floor F, or extended downward out of the sleeve 34D to be "in-contact" with the floor F. The foot pad 32B is driven by a linkage 34B that has one end connected to the foot pad 32B and its other end coupled to a brake bar linkage 34A through a pin 34E (FIG. 3J). When the brake bar 34 is pressed downward by the attendant's foot, the brake bar linkage 34A rotates clockwise, causing the linkage 34B to move the foot pad 32B downward, while causing the pin 34E to move to the left and ride underneath a guide strut 34C (FIG. 3I). The positioning of the pin 34E underneath the guide 34C acts like a "releasable lock" in that in order for the attendant to "unlock" the brake bar 34 from the "locked condition," he or she must apply a larger upward force (compared to the downward force) on the brake bar 34 with his/her foot in order to move the pin 34E to the right along the guide strut 34C and once it clears the guide strut 34C, the upper end of the linkage 34B is free to move upward to the state shown in FIG. 3J. As the linkage 34B moves upward, this causes the brake bar linkage 34A to move upward, thereby retracting the foot pad 32B up into the sleeve 34D. A mounting plate MP is coupled to the releasably locking mechanism to allow the brake bar 34 to be mounted to the lower protective portion 24 of the PAS 20A.

Figure 3K:
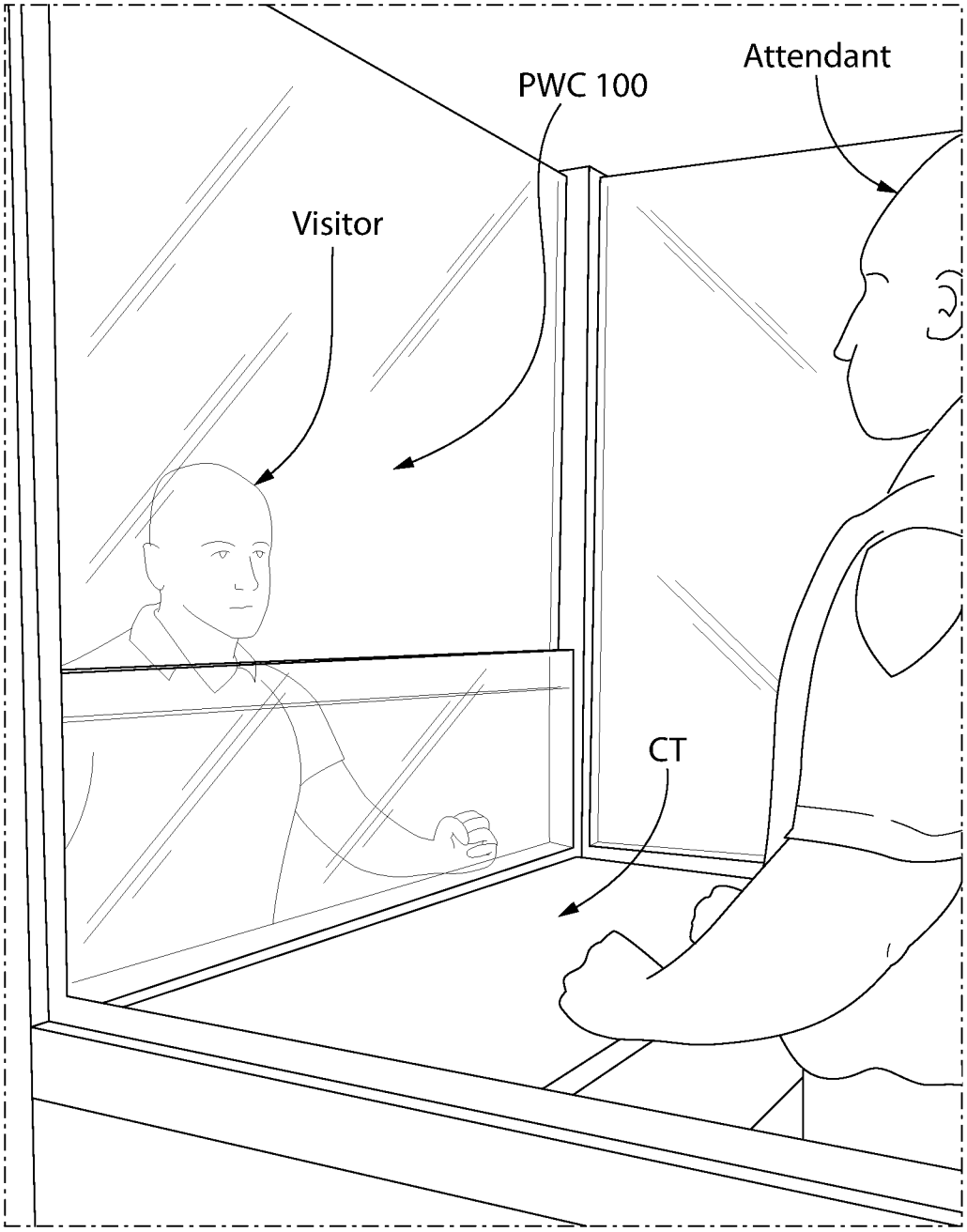
FIG. 3K depicts an attendant within the interior of the mobile PAS communicating with a visitor through the first protective window configuration.

The mobile PAS 20A provides a secure wrap around UL752 bullet-resistant podium by providing staff an ergonomic full height, mobile extended enclosure to minimize confrontation and maximize safe communications/observations to properly perform their job of keeping building occupants out of harm's way. As can be seen most clearly in FIGS. 3B-3D, with the attendant (shown in silhouette, or as shown in FIG. 3K) in the mobile PAS 20A, this ensures appropriate communication from the front only of the mobile PAS 20A, discourages individuals from "side communication". The mobile PAS 20A provides a full width protected designated speaking area, along with sufficient work and storage space. It also provides increased stability from an equal footprint. The PAS 20A provides 84 inches height for providing increased staff protection. It uses oversized high weight capacity wheels for mobility (FIGS. 3E-3H). Handles 24A and 24B are provided on the vertical struts S1 and S4, respectively, to provide the attendant with easy way to pull or otherwise maneuver the mobile PAS 20A, as will be discussed later. In addition, should other security personnel join the attendant, these other personnel can grasp the handles 24A/24B to assist the attendant.

Figure 3L:
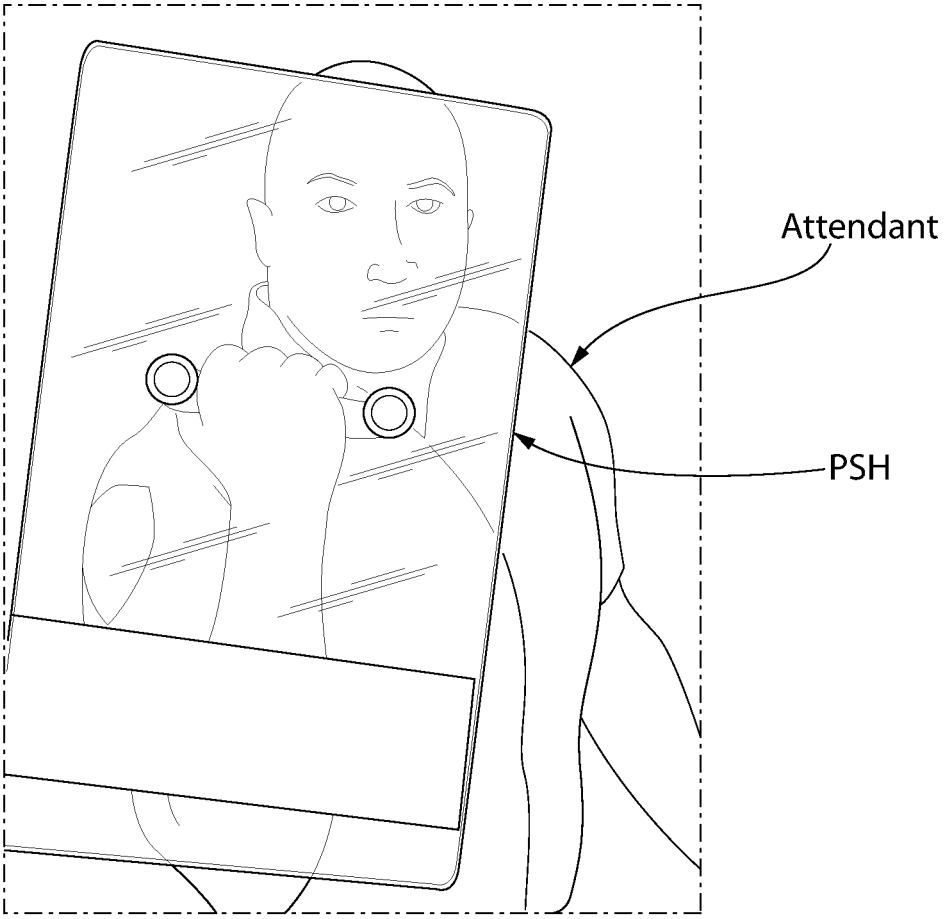
FIG. 3L shows the personal protective shield being held by the attendant of FIG. 3H which can be used by the attendant for additional personal protection and which can be stowed in the storage assembly in the lower portion of the mobile PAS for quick retrieval.

As can seen most clearly in FIGS. 3E-3H, the enclosure of the mobile PAS 20A comprises a durable and easily cleanable material, e.g., stainless steel. The lower portion of the mobile PAS 20A also includes a plurality of storage compartments 28 for a variety of reasons for personal items and protective items for the attendant. One of the storage compartments may even contain a portable shield (PSH, see FIG. 3L) that the attendant can gain quick and easy access to in case the attendant needs to manipulate the portable shield PSH for protection; a door 28A to this one compartment in which the protective shield PSH is stored is shown in FIGS. 3F-3H. A drawer 28B storage compartment and a flip-up door/footrest 28C are also shown in FIGS. 3F-3H.

As mentioned previously, a brake control, e.g., the brake bar 34, is provided for the attendant to quickly and easily activate or release a brake mechanism for mobilizing or immobilizing the PAS 20A. FIGS. 3E-3H depict the foot-activated brake bar 34 control, which is by way of example only. One of the most important aspects of the mobile PAS 20A is that the attendant is given the ability to stay completely within the mobile PAS 20A while moving it to another location should he/she feel the need to move the mobile PAS 20A to a more secure location. The attendant would use the brake control to quickly release the brake mechanism, move the mobile PAS 20A to a more secure location and then lock the brake mechanism using the brake control.

Figure 5:
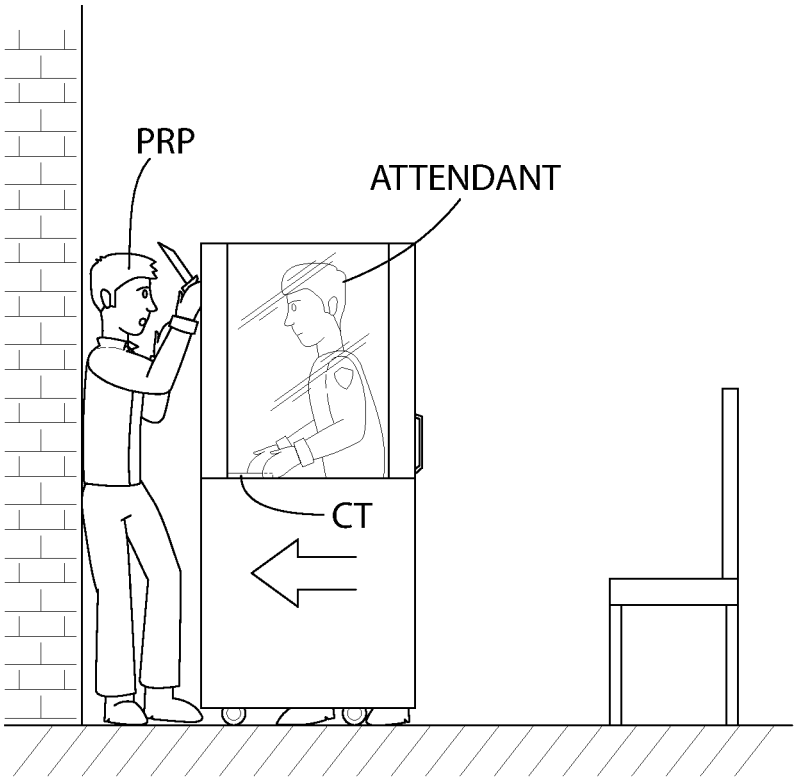
FIG. 5 depicts the mobile PAS being used offensively by the attendant, completely protected within the mobile PAS, against a perpetrator by, for example, pinning the perpetrator against a wall using the large mass of the mobile PAS.

But the mobile PAS 20A can also be used offensively too. Should a perpetrator PRP approach the mobile PAS 20A with the intent to harm the attendant, the attendant can release the brake mechanism and push the mobile PAS 20A (e.g., by pressing against the countertop CT, etc.) into contact with the perpetrator PRP and press the entire mobile PAS 20A against the perpetrator PRP, lock the brake bar 34 and thereby pin the perpetrator against a wall or other structure until authorities or others arrive to assist in the capture of the perpetrator PRP. See FIG. 5. As one can appreciate, the stainless steel composition of the mobile PAS 20A and bullet-resistant PWCs make the mobile PAS 20A a formidable/strong mass that can be offensively used by the attendant to trap a perpetrator against another structure, all the while protecting the attendant therein. Despite the overall weight of the mobile PAS 20A (e.g., approximately 800 lbs), the wheel/castor assemblies allow the mobile PAS 20A to be easily moved when the brake mechanism is released.

The mobile PAS 20A usage requires staff training and the development of facility-wide implementation protocols. In view of the mobility of the PAS 20A, it can be relocated in accordance to various times of the day or other special area needs. Moreover, the mobile PAS 20A provides an aesthetic platform for daily occupant interactions as well as a safe vantage point for building officer observation. Furthermore, the mobile PAS 20A provides significant benefits in a variety of event response scenarios.

It should be noted that the wheel/castor assemblies 26A/26B are configured for use on even floor surfaces. The wheel/castor size for such use is typically a 4 inch diameter wheel and rated for approximately 800 lbs. A pallet jack should be used for substantially uneven floors and/or exterior relocations. Furthermore, where the mobile PAS 20A is used in an outdoor environment, on walkways, sidewalks, pathways, streets/roadways or anywhere the surface upon which the mobile PAS 20 rides is not smooth or continuous, a further embodiment of the mobile PAS 20 comprises electrical linear actuators (e.g., Grainger McMaster linear actuators) powered by an internal battery (e.g., +12/24 VDC) for self-aligning and stabilizing the mobile PAS 20A during motion over these rough outdoor environment surfaces. Moreover, the wheels/castors used for these mobile PAS 20As are typically 8 inch diameter wheels rated for greater than 800 lb loads.

The following is an example of how the mobile PAS 20A can be used in a rapid deployment for a scenario response.

The attendant would determine a high threat level individual and take proportionate required evasive measures:

Take-down: individually overcoming the perpetrator. The attendant would retrieve his/her personal protective shield PSH (e.g., the ThorBoard™ sold by Armor Express of Arlington, VA) from the storage assembly 28 for mitigating direct fire, foreign object deflection or hand-to-hand conflict resolution;

Suspect Control: detaining/restraining via the PAS 20A. The attendant would release the brake mechanism and utilize forward momentum to restrict suspect movement. The attendant would then lock the brake mechanism to temporarily isolate the suspect from the general public;

Officer Preservation/Occupant Rescue: taking a safe-haven for the officer and up to one additional person. The brake mechanism would then be unlocked, and the attendant would relocate to close the open side of the PAS 20A against the wall or other structure. Next, the brake mechanism is engaged and now a 360°, four-sided protection is provided to the attendant inside the PAS 20A.

Stationary Protective Attendant Station (PAS) 20B

As mentioned earlier, an alternative to the mobile PAS 20A is a stationary version 20B that can be installed within a larger attendant station, such as shown in FIG. 2B and FIGS. 4A-4C.

Installation involves modifying each desk as required to ensure a uniform contiguous surface and to bond 14 gage satin finish stainless steel to provide ballistic hardening-floor to counter. The stainless steel profile system is custom-fabricated to mount in accordance with the current barrier configuration. UL752 laminated polycarbonate glazing is used with bull-nosed exposed edges for all transaction and stationary panels.

Unlike the PAS 20A, the stationary version PAS 20B does not comprise side window panels but only a front panel which may take the form of any of the PWCs discussed previously. This is expected since the PAS 20B is integrated within a larger station platform, such as the one shown in FIGS. 2B and 4A-4C.

Figure 4A:
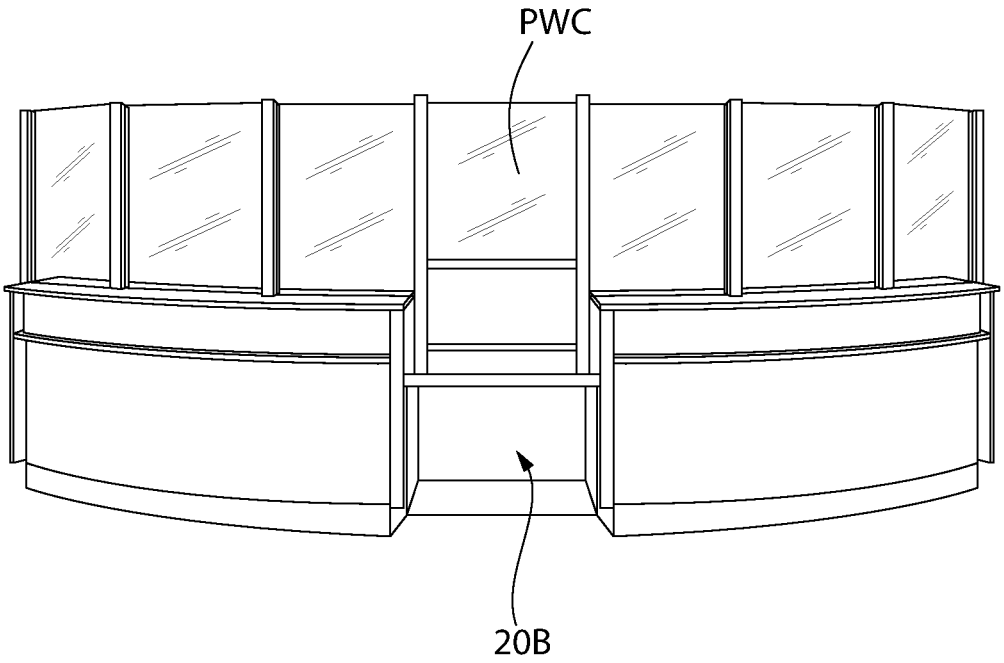
FIG. 4A depicts a stationary PAS of the present invention that is installed within a larger conventional attendant station.
Figure 4B:
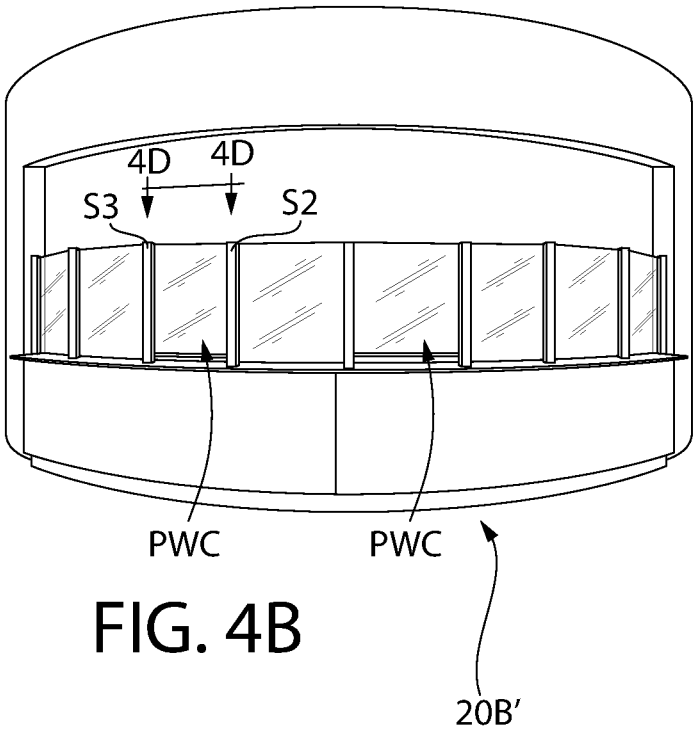
FIGS. 4B and 4C depict a stationary PAS installed in two different "rounded" attendant stations with the use of a universal channel.
Figure 4C:
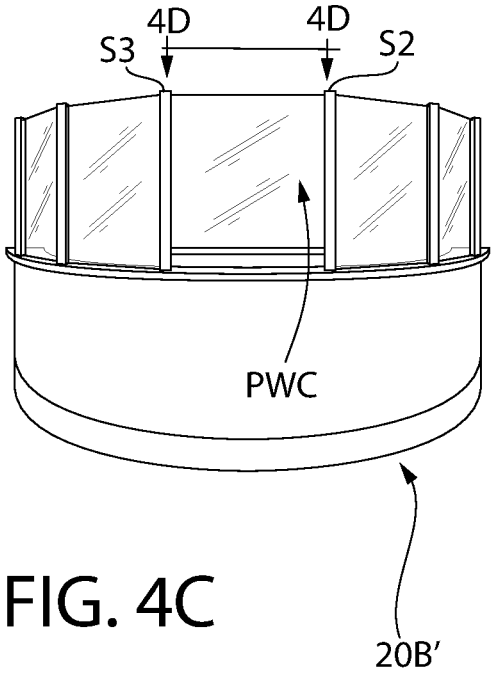
Figure 4D:
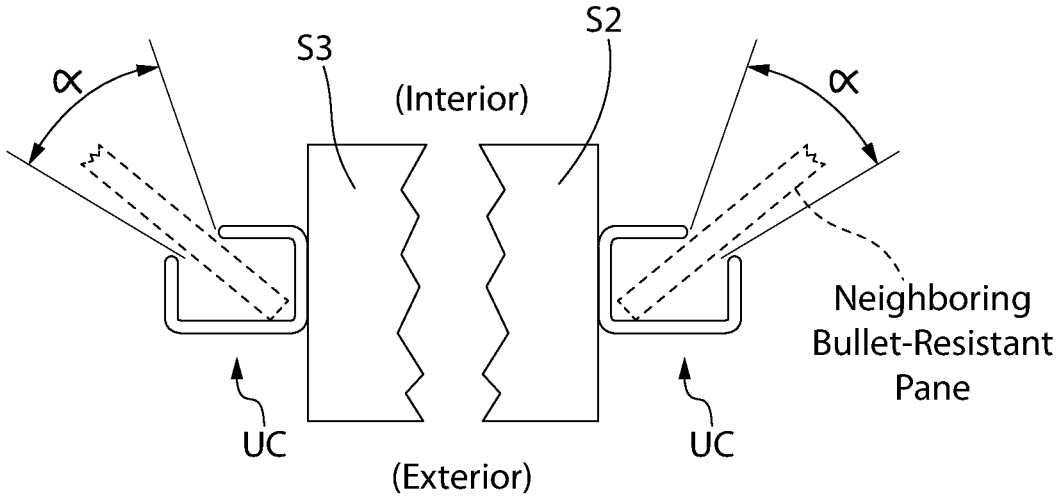
FIG. 4D is a schematic view of the universal channels secured to respective vertical struts, shown partially, taken along line 4D-4D of FIGS. 4B and 4C showing how neighboring bullet-resistant panes, shown in phantom, can be coupled at a custom angle in a range of angles, a, to accommodate a variety rounded attendant stations.

In some instances, it is necessary to install the stationary PAS 20B into a larger rounded attendant station which both together goes by the reference number 20B' in FIGS. 4B and 4C. Many of these rounded attendant stations have different diameters/curvatures. FIGS. 4B and 4C depict a stationary PASs installed in two differently rounded attendant stations 20B'. The ability to accommodate the stationary PAS 20B into differently rounded attendant stations is accomplished with the use of a universal channel UC installed on each side of the stationary PAS and adjacent bullet-resistant panes. As shown most clearly in FIG. 4D, the universal channel is an elongated element that is secured (e.g., welded) along the outside surface each forward vertical strut (e.g., S2 and S3 (see FIG. 3A for vertical strut orientation), shown partially in FIG. 4D from a top view), along the upper portion 22. The top view of the universal channel UC in FIG. 4D shows the rounded rectangular cross-section of the universal channel UC that has an open corner. The open corner width corresponds to the width (e.g., ⅜ inch) of the neighboring bullet-resistant transparent/translucent pane that is inserted therethrough, as shown in FIG. 4D. The design of the universal channel UC allows a wide range, a (e.g., 5°-65°), of angles, for securing the neighboring bullet-resistant pane thereat, all depending on the curvature of the rounded attendant station.

As can appreciated by the above discussion, where the attendant station is not rounded, the universal channel is not used but rather a conventional "U-channel" is used for securing adjacent bullet-resistant transparent/translucent panes to the stationary PAS 20B and other neighboring vertical struts in the attendant station.

The mobile PAS 20 and stationary PAS 20B are sold under the trademarks zFacilitator™ and Facilitator Technologies™.

While the invention has been described in detail and with reference to specific examples thereof, it will be apparent to one skilled in the art that various changes and modifications can be made therein without departing from the spirit and scope thereof.

What is claimed is:

1. A protective attendant station, said station comprising:

an upper portion comprising a protective window configuration that is bullet-resistant and transparent;

a lower portion that is also bullet-resistant, said lower portion further comprising:

a wheel assembly secured to a bottom of said lower portion for forming a mobile protective window station, allowing the attendant to maneuver said protective attendant station to other locations on a floor; and a braking mechanism, controllable by an attendant, for making said mobile protective attendant station temporarily stationary; and wherein said upper portion and said lower portion are secured together to form a station having an interior configured for the presence of the attendant therein and wherein said bullet-resistant and transparent upper portion provide unobstructed communication between the attendant and another person on an outside location of said protective attendant station while also preventing transfer of moisture droplets while minimizing transfer of Covid and other potentially infectious diseases between the another person and the attendant; and wherein said upper portion and said lower portion secured together form an attendant station with an open back portion.

2. The protective attendant station of claim 1 wherein said braking mechanism makes said mobile protective attendant station temporarily stationary on non-level floor surfaces.

3. The protective attendant station of claim 1 wherein said braking mechanism comprises a plurality of vertically-displaceable foot pads, said foot pads deployable by the attendant to lift the wheels out of contact with a floor upon which said wheels roll.

4. The protective attendant station of claim 1 wherein said protective window configuration comprises a pair of bullet-resistant and transparent panes which are vertically-oriented such that one pane forms an upper pane and the other pane forms a lower pane and wherein a lower edge of said upper pane overlaps an upper edge of said upper pane, and wherein said lower pane has a lower edge that is in contact with a countertop in said upper portion.

5. The protective attendant station of claim 1 wherein said protective window configuration comprises a pair of bullet-resistant and transparent panes which are vertically-oriented such that one pane forms an upper pane and the other pane forms a lower pane and wherein a lower edge of said upper pane overlaps an upper edge of said upper pane but said upper and lower panes are displaced horizontally to form a gap to facilitate speaking and protecting against airborne bacteria, and wherein said lower pane has a lower edge that is in contact with a counter top in said upper portion.

6. The protective attendant station of claim 1 wherein said protective window configuration comprises a pair of bullet-resistant and transparent panes which are vertically-oriented such that one pane forms an upper pane and the other pane forms a lower pane and wherein a lower edge of said upper pane overlaps an upper edge of said upper pane but said upper and lower panes are displaced horizontally to form a gap to facilitate speaking, and wherein said lower pane has a lower edge that is positioned above a counter top in said upper portion to allow for pass-through of materials.

7. The protective attendant station of claim 6 further comprising an angled bullet-resistant and transparent pane positioned on said countertop, inward of said station, to permit limited pass-through of materials, while protecting the attendant from any reach-through, airborne bacteria.

8. The protective attendant station of claim 1 wherein said lower portion in said interior comprises at least storage compartment.

9. The protective attendant station of claim 8 wherein a portable ballistic-resistant shield configured for use by the attendant is stowed in said at least one storage compartment.

10. The protective attendant station of claim 1 comprising a plurality of vertical struts for forming said upper portion and said lower portion.

11. The protective attendant station of claim 10 wherein said lower portion and said plurality of vertical struts comprise a non-porous, easily maintainable material which can be sanitized on a regular basis to reduce spread of infection and viruses.

12. The protective attendant station of claim 11 wherein non-porous, easily maintainable material comprises stainless steel.

13. The protective attendant station of claim 1 wherein said bullet-resistant and transparent panes comprise thermoplastic that are Level 1 Ballistic-5.0 and Level III Ballistic-7.5 pounds.

14. A method for using a mobile attendant station to protect an attendant therein, said method comprising:

forming a three-sided enclosure having an upper portion including a protective window configuration that is bullet-resistant and transparent and a lower portion that is also bullet-resistant, said protective window configuration providing unobstructed communication between the attendant and another person on an outside location of said protective attendant station while also preventing transfer of moisture droplets while minimizing transfer of Covid and other potentially infectious diseases between the another person and the attendant, said three-sided enclosure having an open side;

providing a wheel assembly at the bottom of said three-sided enclosure to make said attendant station mobile; and integrating a brake mechanism with said wheel assembly, said brake mechanism, when activated, lifting said wheel assembly off of a floor or ground and engaging foot pads with the floor or ground for releasably locking said station in place, said brake mechanism, when deactivated, lifting said foot pads off the ground or floor and restoring said wheel assembly in contact with the floor or ground.

15. The method of claim 14 further comprising the steps of:

releasing said brake mechanism, by said attendant, and moving said enclosure backward until said open side is placed against a wall; and locking said brake mechanism to completely secure the attendant inside said enclosure and thereby 360° protection to the attendant inside said enclosure.

16. The method of claim 14 further comprising the steps of:

releasing said brake mechanism, by said attendant, and moving said enclosure forward towards an assailant;

forcing said assailant against a wall; and locking said brake mechanism to completely trap the assailant against the wall until authorities arrive.

* * * * *